US008499422B2

(12) United States Patent
Jacobsen

(10) Patent No.: US 8,499,422 B2
(45) Date of Patent: Aug. 6, 2013

(54) SAFETY DEVICE FOR A PIECE OF LUGGAGE COMPRISING A FIRST OUTSIDE ZIPPER AND A SECOND INSIDE ZIPPER

(75) Inventor: Ebbe Jacobsen, Brasschaat (DK)

(73) Assignee: Delsey, Tremblay-en-France (FR)

( * ) Notice: Subject to any disclaimer, the term of this patent is extended or adjusted under 35 U.S.C. 154(b) by 704 days.

(21) Appl. No.: 12/726,539

(22) Filed: Mar. 18, 2010

(65) Prior Publication Data

US 2010/0269311 A1 Oct. 28, 2010

(30) Foreign Application Priority Data

Apr. 24, 2009 (FR) ..... 09 52679
Oct. 30, 2009 (FR) ..... 09 57654

(51) Int. Cl.
*A44B 19/24* (2006.01)
*A44B 19/34* (2006.01)
*A44B 19/22* (2006.01)
*A44B 19/20* (2006.01)

(52) U.S. Cl.
USPC ..... 24/382; 24/383; 24/384

(58) Field of Classification Search
USPC ..... 24/382, 383, 384
See application file for complete search history.

(56) References Cited

U.S. PATENT DOCUMENTS 1,734,434 A 11/1929 Hutchins
2,166,885 A 7/1939 Wiseman
2,229,216 A * 1/1941 Marinsky ..... 24/382
2,321,926 A * 6/1943 Marinsky et al. ..... 24/384
2,454,214 A 11/1948 Sapp
2,641,037 A 6/1953 Gossner
2,693,013 A * 11/1954 Gossner ..... 24/384
3,102,570 A 9/1963 Fairchilds
3,448,463 A * 6/1969 Milone ..... 24/382
4,112,556 A * 9/1978 Flaum et al. ..... 24/382
4,641,400 A * 2/1987 Moreland ..... 24/389
4,875,258 A * 10/1989 Goedecke ..... 24/384
4,987,657 A 1/1991 Moreland
6,092,266 A 7/2000 Lee
6,223,349 B1 5/2001 Rosier
2008/0264815 A1 10/2008 Allen

FOREIGN PATENT DOCUMENTS

DE 199 35 380 2/2001
EP 1 869 990 A1 12/2007
WO 97/07702 A1 3/1997

OTHER PUBLICATIONS

French Search Report dated Dec. 2, 2009, from corresponding French application.
International Search Report, dated Nov. 11, 2010, in PCT/FR2010/050352.

* cited by examiner

*Primary Examiner* — Robert J Sandy
(74) *Attorney, Agent, or Firm* — Young & Thompson

(57) ABSTRACT

A safety device for a piece of luggage includes a first outside zipper (1) and a second inside zipper (2). The two zippers (1, 2) are superposed in the immediate proximity of one another, such that the teeth (1*a*, 2*a*) of the zippers (1, 2) touch under the action of external pressure on the outside zipper (1) by a tip (P) or a pointed tool, by keeping the teeth of the outside zipper (1) from dislocating downward under the pressure of the tip or the pointed tool (P).

18 Claims, 2 Drawing Sheets

SAFETY DEVICE FOR A PIECE OF LUGGAGE COMPRISING A FIRST OUTSIDE ZIPPER AND A SECOND INSIDE ZIPPER

The invention relates to a safety device for a piece of luggage that comprises a first outside zipper and a second inside zipper.

The invention is particularly useful for improving the safety of luggage equipped with zippers.

The invention applies to luggage in general, to suitcases, to PC cases, to various containers, to business accessories, to bags, to knapsacks, etc., which may or may not be equipped with wheels.

BACKGROUND OF THE INVENTION

The luggage that is equipped with zippers offers inadequate protection against theft even when the latter is equipped with a padlock. Actually, when the luggage that is equipped with zippers cannot be seen by its owner and is handled by transport operators, the zippers can be opened by pressure from a pointed object or a tip between the teeth of the zipper. The pressure thus implemented between the teeth of the zipper makes it possible to push the teeth of the zipper downward, to separate these teeth and to disengage them. After several teeth are disengaged, it is possible to open the zipper by simply pulling to extend the opening in series over the entire zipper, thus making it possible to open the suitcase or the piece of luggage. This operation that is executed with a moderate pressure does not leave visible traces on the teeth that are separated. After examination of the contents of the piece of luggage and optionally removal of a portion, the operator recloses the zipper by a back-and-forth motion of the slider, without leaving traces.

The first object of the invention is to eliminate the drawbacks of the known prior art by proposing a new safety device for a piece of luggage comprising a first outside zipper and a second inside zipper.

The document U.S. Pat. No. 6,223,349-B1 describes a closing means for a wet suit, in particular made of chloroprene rubber. This closing means cannot constitute a safety device for a piece of luggage because of the fact that the teeth of the outside zipper can easily be separated by exerting an outside pressure by a tip or a pointed tool on the outside zipper. In addition, the arrangement of the closing means comprises internal sealing layers and an intermediate seal that cannot be used on a piece of luggage that requires frequent openings or closings.

The document U.S. Pat. No. 2,641,037 describes a sealing closure that comprises a first outside zipper and a second outside zipper. This sealing closing cannot constitute a safety device for a piece of luggage because of the fact that the teeth of the first outside zipper open by exerting a pressure by a tip or a pointed tool.

The document US 2008/0264815-A1 describes a weapons case that has a rigid outside surface. The weapons case comprises an outside zipper and lower sealing lips. This weapons case cannot be used as a piece of luggage that has a safety device because of the fact that the teeth of the single zipper do not resist the separation force exerted by a tip or a pointed tool.

The document DE 19935380-A1 describes a zipper for clothing that is weather-resistant. This zipper cannot be used as a safety device for a piece of luggage because of the fact that its teeth can be separated by a tip or a pointed tool.

The document U.S. Pat. No. 2,166,885 describes an airtight receptacle. This airtight receptacle comprises a zipper associated with the combination of two inside elastic sealing bands. This device cannot be used as a safety device for a piece of luggage because of the fact that the teeth of the zipper can be separated by a tip or a pointed tool.

The document U.S. Pat. No. 3,102,570 relates to sealing means for a zipper. The combination of the sealing means and the zippers does not make it possible to constitute a safety device for a piece of luggage, because of the fact that the teeth of the outside zipper can be separated by a tip or a pointed tool and the sealing means can then be separated before opening the second zipper by separating teeth by a tip or a pointed tool.

The document U.S. Pat. No. 2,454,214 describes a closure comprising two zippers and intermediate sealing means. This closure cannot be used as a safety device for a piece of luggage because of the fact that the teeth of the outside zipper can be separated by means of a tip or a pointed tool.

The document U.S. Pat. No. 1,734,434 describes a closure for openings that have to be sealed against air, gas and water. This closure cannot be used as a safety device for a piece of luggage because of the fact that the teeth of the outside zipper can be separated by means of a tip or a pointed tool.

A second object of the invention is to provide a safety device for a piece of luggage that comprises a first outside zipper and a second inside zipper with economical production and easy and ergonomical use.

The zippers for a piece of luggage should actually be easy to open and to close and for this reason cannot comprise thick teeth made of injected plastic that open and close with difficulty and are subject to a high breakage point.

The zippers that are usually used for the luggage are generally closures with small teeth, preferably made of polyamide (nylon, registered trademark), which open and close easily in a straight line, in corners and curves, with a very low breakage point.

A third object of the invention is to provide an improved safety device for a piece of luggage that is equipped with a first outside zipper and a second inside zipper, in which the zippers have teeth sizes and characteristics that are close to those that are usually used for the luggage that is equipped with a single zipper.

SUMMARY OF THE INVENTION

The invention has as its object a safety device for a piece of luggage that comprises a first outside zipper and a second inside zipper, characterized by the fact that the two zippers are superposed in the immediate proximity of one another, such that the teeth of the zippers touch under the action of external pressure on the outside zipper using a tip or a pointed tool, by keeping the outside zipper from dislocating under the pressure of the tip or the pointed tool.

According to other alternative characteristics of the invention:

- The two zippers are superposed with an offset that ensures the contact between the teeth under the action of an outside pressure;
- The two zippers are superposed essentially on one another;
- The free width of the first outside zipper is greater than the free width of the second inside zipper;
- The free width of the first outside zipper is close to the free width of the second inside zipper;
- The free width of the first outside zipper is slightly less than the free width of the second inside zipper;
- The edges of the first outside zipper and the second inside zipper are made integral with one another for positioning them relative to one another;

The two zippers are controlled by a unique slider means comprising two superposed sliders;

The two superposed sliders are sliders that are superposed with an offset;

The two superposed sliders are sliders that are superposed exactly on one another;

The single slider means comprises a first slider and a second slider that are superposed and made integral with a bridge that bears a single pull tab.

BRIEF DESCRIPTION OF THE DRAWINGS

The invention will be better understood using the following description that is provided by way of nonlimiting example with reference to the accompanying drawings in which.

DETAILED DESCRIPTION OF THE PREFERRED EMBODIMENTS

With reference to FIGS. 1 to 8, the elements that are identical or operationally equivalent are referenced by identical reference numbers.

Figure 1:
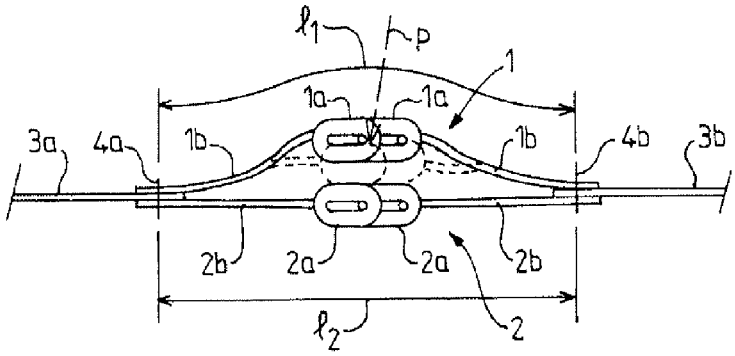
FIG. 1 diagrammatically shows a transversal cutaway view of a first embodiment of the device according to the invention.

In FIG. 1, a first embodiment of the device according to the invention comprises a first outside zipper 1 and a second inside zipper 2.

The zippers 1 and 2 are assembled at the edges 3*a*, 3*b* of a shell of a piece of luggage that is not shown in its entirety along assembly lines 4*a*, 4*b*.

The length of the curve that is defined by the midline of the outside zipper 1 between the proximal assembly lines, here 4*a*, 4*b*, is called "free width" and is referenced by the reference $l_1$.

The length of the curve that is defined by the midline of the second inside zipper 2 and included between the proximal assembly lines, here 4*a*, 4*b*, is called "free width" and is referenced by the reference $l_2$.

Each zipper 1 or 2 comprises an alignment of pairs of cooperating teeth 1*a* or 2*a*, and two selvages 1*b* or 2*b* for assembly of the corresponding teeth 1*a* or 2*a*.

When a compressive force is exerted on the teeth 1*a* of the outside zipper 1 by a tip P or a pointed tool, the selvages 1*b* bend and the teeth 1*a* rest on the teeth 2*a* of the second inside zipper 2.

The rigid support provided by the teeth 2*a* of the second inside zipper 2 keeps the teeth of the outside zipper 1 from dislocating under the pressure of the tip or the pointed tool P and keeps the tip P from penetrating between the teeth 1*a* of the first outside zipper 1.

This protection against forced entry also results from the fact that the free width $l_1$ of the first outside zipper 1 is similar to or greater than the free width $l_2$ of the second inside zipper 2.

In the embodiment of FIG. 1, the zippers 1 and 2 are essentially superposed on one another.

Figure 2:
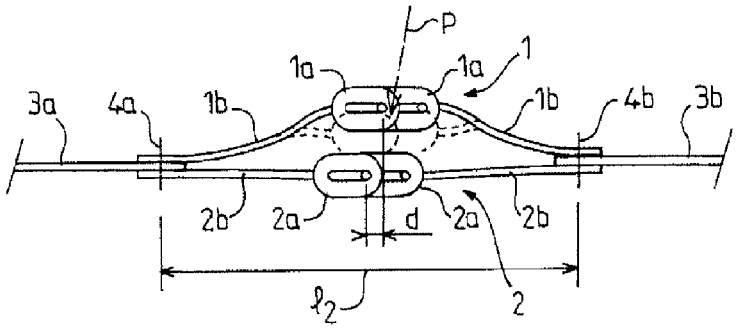
FIG. 2 diagrammatically shows a transversal cutaway view of a second embodiment of the device according to the invention.

In FIG. 2, a second embodiment of the device according to the invention comprises elements that are identical to the elements that are described with reference to FIG. 1.

In this embodiment, the two zippers 1 and 2 are superposed with an offset d.

The offset d is selected by one skilled in the art such that the teeth 1*a* and 2*a* of the zippers 1 and 2 touch when an outside pressure is exerted on the outside zipper 1 by a tip P or a pointed tool.

The contact of the teeth 1*a* and 2*a* of the zippers 1 and 2 ensures a rigid support that keeps the teeth of the first outside zipper 1 from dislocating under the pressure of the tip or the pointed tool P.

The free width $l_1$ of the first outside zipper 1 is similar to or greater than the free width $l_2$ of the second inside zipper 2.

The invention also extends to variants that are not shown in which the free width of the first outside zipper 1 is close to or even slightly less than the free width of the second inside zipper 2, whereby the essential thing is that the teeth of the outside zipper 1 touch the teeth of the second inside zipper 2 when pressure is exerted on the outside zipper 1 by a tip or a pointed tool.

Figure 3:
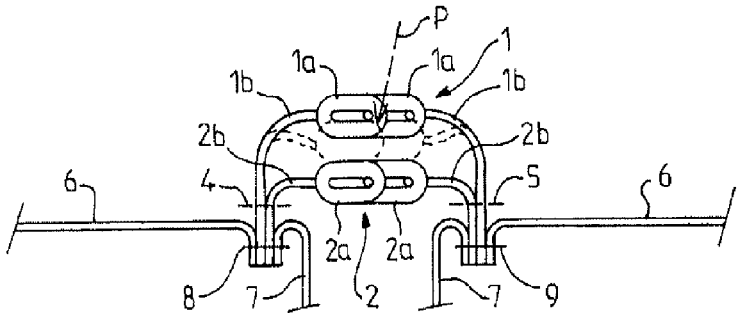
FIG. 3 diagrammatically shows a transversal cutaway view of a third embodiment of the device according to the invention.

In FIG. 3, a third embodiment of the device according to the invention comprises two zippers 1 and 2.

The edges or selvages 1*b* and 2*b* are assembled in advance along lines 4 and 5 to position the first and second zippers 1 and 2, one relative to the next.

The assembly lines 4 and 5 of the two zippers can be positioned on the outside or on the inside of the lines for attachment to the shell of the piece of luggage.

The zippers 1 and 2 can be controlled individually, each by its own slider, not shown.

In this example, the free width of the first outside zipper 1 is the length of its midline between the proximal assembly lines 4 and 5; the free width of the second outside zipper 2 is the length of its midline between the proximal assembly lines 4 and 5.

After having carried out the preliminary positioning of the zippers 1 and 2 by attachment along assembly lines 4 and 5, preferably by sewing, the assembly of the zippers 1 and 2 is then attached to the walls 6 and 7 of a piece of luggage along attachment lines 8 and 9.

If the assembly lines 4 and 5 of the two zippers were positioned outside of the lines for attachment to the shell of the piece of luggage, the free width of the first outside zipper 1 would be the length of its midline between the proximal attachment lines 8 and 9; the free width of the second outside zipper 2 would be the length of its midline between the proximal attachment lines 8 and 9.

When pressure is exerted by the tip or the pointed tool P on the first outside zipper 1, the teeth 1*a* come into contact with the teeth 2*a* of the second inside zipper 2 and rest on the latter to withstand the penetration of the tip or the pointed tool P and to keep them from dislocating.

Figure 4:
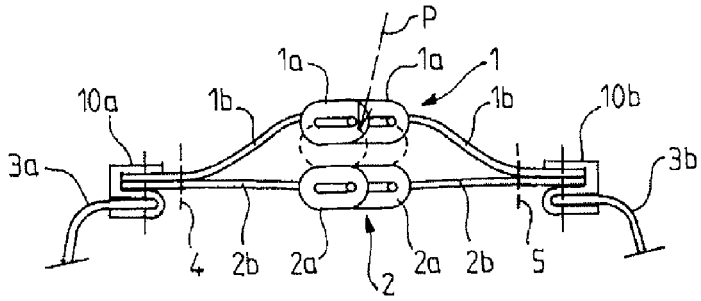
FIG. 4 diagrammatically shows a transversal cutaway view of a fourth embodiment of the device according to the invention.

In FIG. 4, a fourth embodiment of the device according to the invention comprises a first outside zipper 1 and a second inside zipper 2.

Each zipper 1 or 2 comprises teeth 1*a* or 2*a* that work with one another and edges or selvages 1*b* or 2*b*.

The edges or selvages 1*a* of the first zipper 1 are preferably assembled on the edges or selvages 2*a* of the second inside zipper 2 along positioning lines 4 and 5.

The assembly lines 4 and 5 of the two zippers can be positioned on the outside or the inside of the shell of the piece of luggage, i.e., between the teeth 1*a* and 2*a*, on the one hand, and the end of 1*b* and 2*b*, on the other hand.

The thus produced assembly is mounted on the edges 3*a*, 3*b* of a shell of a rigid piece of luggage by means of a protective lip 10*a*, 10*b*, preferably made of PVC (polyvinyl chloride).

Figure 5:
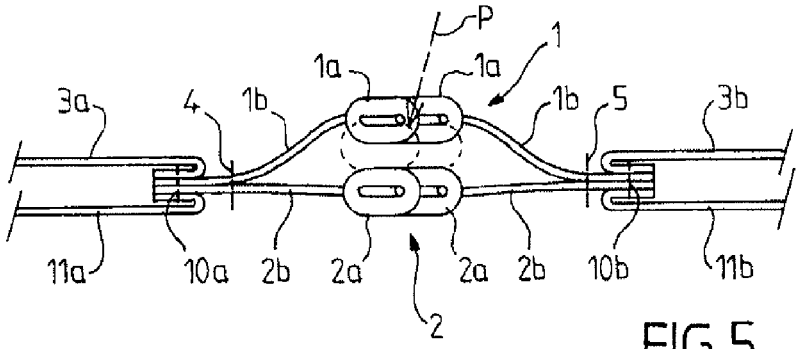
FIG. 5 diagrammatically shows a transversal cutaway view of a fifth embodiment of the device according to the invention.

In FIG. 5, a fifth embodiment of the device according to the invention comprises a first outside zipper 1 that is equipped with its teeth 1*a* and its selvages or edges 1*b*, and a second inside zipper 2 that is equipped with its teeth 2*a* and its selvages or edges 2*b*.

The edges or selvages 1*b* and 2*b* are preferably positioned and attached to one another along positioning lines 4 and 5.

The assembly lines 4 and 5 of the two zippers can be positioned on the outside or on the inside of the lines for attachment to the shell of the piece of luggage.

The thus produced assembly is mounted on a flexible wall 3*a*, 3*b* of a suitcase or a flexible piece of luggage and also on an inside lining 11*a*, 11*b* of the suitcase or flexible piece of luggage.

Because of the resultant positioning of the assembly along lines 4 and 5, the force that is exerted by a pointed tool P or a tip on the teeth 1*a* of the outside zipper 1 brings the teeth 1*a* into contact with the support teeth 2*a* and keeps the teeth 1*a* from penetrating and separating under the action of the tip or the pointed tool P.

The invention applies to all types of bags, luggage, various containers that may or may not be equipped with wheels and that may be rigid or flexible.

Figure 6:
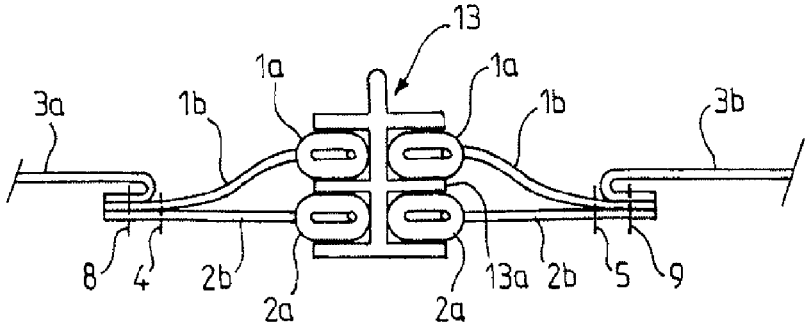
FIG. 6 diagrammatically shows a transversal cutaway view of a sixth embodiment of the device according to the invention.

In FIG. 6, a sixth embodiment of the device according to the invention is particularly advantageous in its application to flexible or semi-rigid luggage.

The device comprises a first outside zipper 1 with teeth 1*a* and edges or selvages 1*b*, and a second inside zipper 2 with teeth 2*a* and edges or selvages 2*b*.

The zippers 1 and 2 are preferably positioned by assembly along two positioning lines 4 and 5 before being assembled with the flexible fabric 3*a*, 3*b* of a shell of a flexible piece of luggage.

Preferably, the outside and inside zippers 1 and 2 are arranged essentially one above the other.

The engagement and disengagement of the teeth 1*a*, 2*a* of the two zippers 1 and 2 are controlled by the movement of a single slider means 13.

The invention also covers, however, the case of two zippers that have a small lateral offset d that is less than two widths of a zipper tooth.

The vertical space that is measured between the teeth of the two outside and inside zippers is preferably less than the thickness of a tooth and a half of the zipper.

Thanks to the single slider means 13, the outside closure and the inside closure are closed simultaneously. After complete closing of the piece of luggage, a tip or a pointed object P that is inserted between two teeth 1*a* does not make possible the penetration of the teeth 1*a* and their disengagement that can lead to an opening of the suitcase or the flexible piece of luggage by forced entry.

The locking and the holding of the teeth 1*a* of the outside zipper by the support provided by the teeth 2*a* of the inside zipper thus prevent an operator from opening the suitcase or flexible piece of luggage by forced entry.

The invention thus makes it possible to place an inside support that consists of the inside zipper 2 directly under the outside zipper 1 and over its entire length by keeping the tooth 1*a* from the outside zipper from penetrating and disengaging.

This inside zipper 2 thus provides a support structure that constitutes a reinforcement and holding of teeth 1*a* of the outside zipper.

The single central slider 13 comprises a first space that works with the teeth 1*a* of the outside zipper and a second space that works with the teeth 2*a* of the inside zipper.

The single slider 13 preferably comprises a separation between the two above-mentioned spaces, preferably an intermediate bar 13*a*, whose thickness is less than the thickness of a tooth 1*a* or 2*a*.

Thanks to the single central slider 13, the actuation of the outside zipper 1 and the actuation of the inside zipper 2 are simultaneous.

This simultaneous actuation and cooperation of the respective teeth 1*a* and 2*a* also reinforces the reliability of the respective positioning of the outside and inside zippers 1 and 2.

The use of a central slider 13 with double actuation makes it possible to reduce the space in a closed position between the teeth 1*a* and 2*a*, which also improves the action of resistance to the penetration of a tip P, achieved using the support obtained by the teeth 2*a* of the inside zipper.

Figure 7:
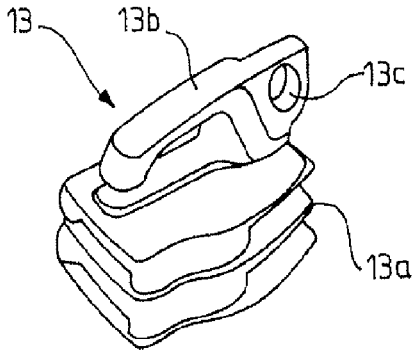
FIG. 7 diagrammatically shows a perspective view of a single slider means of the device according to the invention.

In FIG. 7, the single central slider reproduces the shape of two sliders of the prior art that are superposed one above the other with a single upper bridge 13*b* that is equipped with an eyelet 13*c* that is designed to allow the insertion of a locking element such as a padlock.

The bridge 13*b* is shaped to work with a single pull tab, not shown. By actuating this single pull tab, the user opens or closes the two superposed zippers by carrying out quick and easy manipulations that are identical to the manipulations that are carried out on an unsecured suitcase of the prior art.

The invention can also apply to a device that comprises two zippers of different sizes. In this variant, not shown, and in the case of a single central slider, the slider will have a different shape on the upper half from that on the lower half, whereby the shapes are adapted to different sizes of the zippers.

Figure 8:
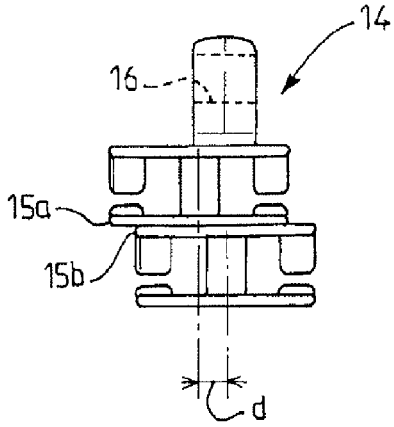
FIG. 8 diagrammatically shows a transversal cutaway view of another single slider means of the device according to the invention.

In FIG. 8, another means of a single central slider 14 reproduces the shape of two sliders of the prior art that are superposed with a transversal offset d that corresponds to a device of the type that is described with reference to FIG. 2, in which the two zippers 1 and 2 are superposed with a transversal offset d.

The invention applies to all variants of the device that are obtained by using two sliders of the prior art that are superposed with an offset, regardless of the direction of this offset. If the partial sliders are superposed with a longitudinal offset d, the single central slider corresponds to a device in which the two zippers of the same size are superposed optionally with a longitudinal offset. If the partial sliders are superposed with an offset on the slant, the single central slider that is thus constituted corresponds to a device in which the two zippers are superposed on one another with an offset that corresponds to the transversal component of this offset on a slant.

The single central slider 14 of FIG. 8 comprises a locking eyelet 16 that is designed for the passage of a padlock-type element. The single central slider 14 of FIG. 8 can also comprise two separation interfaces 15*a*, 15*b*, in the case of an offset d that is close to the width of a zipper tooth.

The invention that is described with reference to several embodiments is in no way limited and on the contrary covers any modification of shape and any variant embodiment within the scope and the spirit of the invention.

The invention also applies to a device that is obtained by using two half-sliders of different shapes. In this variant, not shown, the slider has a different half-slider shape on the left half from that on the right half to adapt to various zippers or else has different shapes for each of the two half-sliders.

The invention also applies to a device that is obtained by using two half-sliders that comprise barriers of separation from offset teeth. In this variant, not shown, the slider has a different separation barrier shape on the upper half from that on the lower half, arranged to reduce the force of tension.

Thanks to the invention, the fluidity and the facility of opening and closing a device with zippers are similar to the fluidity and the facility of opening and closing an unsecured suitcase of the prior art, and this within straight lines as well as within curves and corners.

A preferred process for assembling a device according to the invention comprises the following stages:

Assembling the two zippers that are superposed, for example by sewing or by welding or gluing;

Assembling, only then, the assembly by two zippers being superposed with the suitcase, for example by sewing or by welding or by gluing.

Thanks to a preferred assembly process according to the invention, the two zippers have approximately the same length, which imposes uniform travel with the single central slider despite various curves on various radii of the suitcase.

Despite the difference in radius, the half-slider of the top and the half-slider of the bottom actually travel the same distance. This prevents offsets in the travel of the single central slider.

Thanks to the preferred assembly process according to the invention, the teeth of the outside and inside zippers are essentially aligned in the vertical axis of the final product, and the two zippers are drawn toward one another as well as possible.

To facilitate the passage of corners and to prevent a risk of premature wear of the strip due to the upper friction in the corners, the device with a single central slider is arranged to prevent the "diving" and braking of the slider and to compensate for the differences in length of the two zippers when they are positioned on a different radius. For this purpose, an increase of the band width or selvage is provided relative to the prior art to increase the passage of the slider.

An increase of the size of the pull tab is also provided relative to the prior art to facilitate the pulling and advancing of the slider.

A reduction in the height of the bridge of the slider and a positioning of the shaft of the pull tab on the bridge, making possible a long travel to the rear of the slider during the opening and over the front of the slider during the closing and making it possible to draw the pulling center closer to the center of gravity of the slider, ultimately are provided to prevent the "diving" and braking of the slider, such that any additional pressure exerted on the tip or the pointed tool only reinforces the plating of the outside zipper against the inside zipper by thus increasing the action of locking and resistance to forced entry.

One skilled in the art can adapt the invention according to variants, not shown, so as to obtain the action of supporting and locking the teeth by achieving resistance to the forced entry.

The alignment of the zippers can vary within the scope of this invention, the essential thing being to achieve the action of resistance to the forced entry that is described in each of the embodiments shown.

The inside and outside zippers can be the same or different, both as regards their geometries and as regards their production materials. The inside and outside zippers can be placed symmetrically or not relative to one another. The teeth of the two zippers can be exhibited toward the outside or the inside of the piece of luggage.

Finally, the invention covers the embodiments that use devices with more than two superposed zippers or with more than two superposed sliders, for example three superposed zippers or three superposed sliders, with or without offset.

The preferred embodiments use inside and outside zippers that were previously sewn before being attached to the shell of the corresponding piece of luggage.

Any other additional means that makes possible the placing of the outside zipper against the inside zipper and the resistance to the forced entry can be used without exceeding the scope of this invention: in particular, a VELCRO (registered trademark)-type attachment against the inside zipper.

The invention also applies to a device that is obtained by superposing two zippers of different sizes on one another. In this variant, not shown, the slider has a different shape on the upper half from that on the lower half to adapt to two different sizes of the zipper. This variant, not shown, of the device with differentiated zippers is economical and is to be adapted to a curved shape and to an easy and quick opening because of different opening and closing speeds on the two zipper strips to prevent folds in one of the zippers or an offset of travel, or a locking of the slider and differences in dimensions or specifications of the two zipper sizes that can impair the quality and the fluidity of the sliding upon closing and opening.

The invention claimed is:

1. A safety device for a piece of luggage, comprising:

a first outside zipper (1) comprising a plurality of first teeth (1*a*); and a second inside zipper (2) comprising a plurality of second teeth (2*a*), wherein the outside and inside zippers (1, 2) are superposed in an immediate proximity of one another, such that the first and second teeth (1*a*, 2*a*) of the outside and inside zippers (1, 2), respectively, touch under an action of an external pressure on the outside zipper (1) using a tip or a pointed tool (P) in such a way that, when the external pressure is exerted by the tip or the pointed tool (P) on the outside zipper (1), the first teeth (1*a*) are caused to come into contact with the second teeth (2*a*) and to rest on the inside zipper (2) to withstand against penetration of the tip or the pointed tool (P) and to prevent the first teeth from dislocating downward under the external pressure of the tip or the pointed tool (P).

2. The device according to claim 1, wherein the outside and inside zippers (1, 2) are superposed with an offset (d) that ensures the contact between the teeth (1*a*, 2*a*) under the action of external pressure.

3. The device according to claim 1, wherein the outside and inside zippers (1, 2) are superposed essentially on one another.

4. The device according to claim 1, wherein a free width ($l_1$) of the outside zipper (1) is greater than or equal to a free width ($l_2$) of the inside zipper (2).

5. The device according to claim 1, wherein a free width of the outside zipper (1) is close to or slightly less than a free width of the inside zipper (2).

6. The device according to claim 1, wherein respective edges (1*b*, 2*b*) of the outside zipper (1) and the inside zipper (2) are made integral with one another (4, 5) for positioning them relative to one another.

7. The device according to claim 1, wherein the outside and inside zippers (1, 2) are controlled by a single slider means (13) that comprises two superposed sliders.

8. The device according to claim 7, wherein the two superposed sliders are superposed with respect to each other with an offset (d).

9. The device according to claim 7, wherein the two superposed sliders are superposed exactly on one another.

10. The device according to claim 7, wherein the single slider means (13, 14) comprises a first slider, and a second slider of a different size from the first slider, the first and second sliders being superposed, and the first and second sliders are made integral with a bridge that bears a single pull tab.

11. The device according to claim 2, wherein the outside and inside zippers (1, 2) are superposed essentially on one another.

12. The device according to claim 2, wherein a free width ($l_1$) of the outside zipper (1) is greater than or equal to a free width ($l_2$) of the inside zipper (2).

13. The device according to claim 3, wherein a free width ($l_1$) of the outside zipper (1) is greater than or equal to a free width ($l_2$) of the inside zipper (2).

14. The device according to claim 2, wherein a free width of the outside zipper (1) is close to or slightly less than a free width of the inside zipper (2).

15. The device according to claim 3, wherein a free width of the outside zipper (1) is close to or slightly less than a free width of the inside zipper (2).

16. A safety device for a piece of luggage, comprising:

a first outside zipper (1); and a second inside zipper (2), wherein the outside zipper (1) comprises a plurality of first teeth (1*a*) that, when the first teeth are fastened, form a plurality of first spaces located between the first teeth, and wherein the inside zipper (2) comprises a plurality of second teeth (2*a*) that, when the second teeth are fastened, form a plurality of second spaces located between the second teeth, wherein the outside and inside zippers (1, 2) are superposed in the immediate proximity of one another, such that the first and second teeth (1*a*, 2*a*) of the outside and inside zippers (1, 2), respectively, touch under the action of an external pressure on the outside zipper (1) using a tip or a pointed tool (P) in such a way that, when the external pressure is exerted by the tip or the pointed tool on the outside zipper (1), the first teeth (1*a*) are caused to come into contact with the second teeth (2*a*) and to rest on the inside zipper (2) to withstand against penetration of the tip or the pointed tool P and to prevent the first teeth from dislocating downward under the external pressure of the tip or the pointed tool (P).

17. A safety device for a piece of luggage, comprising:

a first outside zipper (1) comprising a first two rows of plural, interlocking first teeth (1*a*);

a first slider that moves along a first length of the first two rows in a first path for fastening or separating the first two rows from one another;

a second inside zipper (2) comprising a second two rows of plural, interlocking second teeth (2*a*);

a second slider that moves along a second length of the second two rows in a second path for fastening or separating the second two rows from one another;

first and second outside edges (1*b*) connected respectively to the first two rows of the outside zipper (1); and first and second inside edges (2*b*) connected respectively to the second two rows of the inside zipper (2), wherein the respective first and second lengths of the outside and inside zippers (1, 2) are superposed one over the other, wherein the first outside edge and the first inside edge are fastened to each other along a first seam in a direction of the first and second lengths, and the second outside edge and the second inside edge are fastened to each other along a second seam in a direction of the first and second lengths, wherein, in a fastened mode where the outside zipper (1) and the inside zipper (2) are both fastened, the first and second outside edges (1*b*) and the outside zipper (1) form a first assembly that curves over a second assembly comprising the first and second inside edges (2*b*) and the inside zipper (2), and wherein, in the fastened mode, a length running along the first and second outside edges (1*b*) from the first seam to the second seam is greater than a length running along the first and second inside edges (2*b*) from the first seam to the second seam.

18. The safety device according to claim 17, wherein, in the fastened mode, a length running along the first and second inside edges (2*b*) from the first seam to the second seam presents a flat profile.

* * * * *